US006378416B1

(12) United States Patent
Kato et al.

(10) Patent No.: US 6,378,416 B1
(45) Date of Patent: Apr. 30, 2002

(54) SWASH PLATE TYPE COMPRESSOR PISTON WHEREIN INNER SURFACE OF HOLLOW CYLINDRICAL SECTION OF BODY PORTION HAS AXIALLY EXTENDING REINFORCING PROJECTIONS

(75) Inventors: Takayuki Kato; Seiji Katayama, both of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 17 days.

(21) Appl. No.: 09/649,972

(22) Filed: Aug. 29, 2000

(30) Foreign Application Priority Data

Sep. 1, 1999 (JP) ..... 11-247112

(51) Int. Cl.[7] ..... F01B 3/02; F16J 1/00
(52) U.S. Cl. ..... 92/71; 92/172
(58) Field of Search ..... 92/71, 172, 159

(56) References Cited

U.S. PATENT DOCUMENTS 1,714,145 A * 5/1929 Sperry ..... 92/71
3,882,762 A * 5/1975 Hein ..... 92/172
5,174,728 A * 12/1992 Kimura et al. ..... 92/159
5,765,464 A * 6/1998 Morita ..... 92/172

FOREIGN PATENT DOCUMENTS

FR 505264 * 7/1920 ..... 92/159
JP A-9-250451 9/1997
JP A-10-159725 6/1998

* cited by examiner

*Primary Examiner*—F. Daniel Lopez
(74) *Attorney, Agent, or Firm*—Woodcock Washburn LLP

(57) ABSTRACT

A piston for a swash plate type compressor including a head portion which includes a cylindrical body portion whose open end is closed by a closure member, and an engaging portion which is formed integrally with the head portion on the side remote from the open end and which engages a swash plate of the compressor, wherein: the body portion includes a hollow cylindrical section whose inner circumferential surface is provided with a plurality of axially extending reinforcing projections, each of which protrudes from the inner circumferential surface in a radially inward direction of the hollow cylindrical section and which extends in a direction parallel to a centerline of the hollow cylindrical section over a substantially entire axial length thereof, the closure member being fixed to the body portion such that the closure member is held in abutting contact with an end face of each of the reinforcing projections on the side of the open end of the body portion.

6 Claims, 9 Drawing Sheets

SWASH PLATE TYPE COMPRESSOR PISTON WHEREIN INNER SURFACE OF HOLLOW CYLINDRICAL SECTION OF BODY PORTION HAS AXIALLY EXTENDING REINFORCING PROJECTIONS

This application is based on Japanese Patent Application No. 11-247112 filed Sep. 1, 1999, the contents of which are incorporated hereinto by reference.

BACKGROUND OF THE INVENTION

1. Field of the Invention

The present invention relates to a piston for a swash plate type compressor, and more particularly to techniques for reducing the weight of the piston.

2. Discussion of the Related Art

As a piston used in a swash plate type compressor, there are known a single-headed piston and a double-headed piston. The single-headed piston includes a head portion which is slidably fitted in a cylinder bore formed in a cylinder block of the compressor and an engaging portion formed integrally with the head portion for engaging a swash plate. The double-headed piston includes two head portions on the opposite sides of a single engaging portion. Since the piston is reciprocated within the cylinder bore, it is desirable to reduce the weight of the piston. It is generally required to reduce the weight of the single- or double-headed piston used in a swash plate type compressor of fixed capacity type wherein the angle of inclination of the swash plate with respect to a plane perpendicular to the axis of the drive shaft of the compressor is fixed. The single-headed piston is usually used in a swash plate type compressor of variable capacity type wherein the angle of inclination of the swash plate is variable to change the discharge capacity of the compressor. When the single-headed piston is used in the variable capacity type swash plate compressor, it is particularly required to reduce its weight in order to achieve a stable operation of the compressor and reduce the noise of the compressor during its operation.

JP-A-10-159725 discloses a technique of reducing the weight of the piston. Described in detail, this publication discloses a method of producing a single-headed piston with a hollow head portion, by closing an open end of a cylindrical body portion of the piston with a closure member. The piston produced according to this method has a considerably reduced weight. However, the weight of the piston cannot be reduced to a satisfactory extent which permits the piston to be used in the swash plate type compressor of variable capacity type wherein the drive shaft is required to be rotated at a relatively high speed to achieve high operating performance of the compressor.

SUMMARY OF THE INVENTION

The present invention was made in the light of the background art described above. It is a first object of the present invention to provide a piston for a swash plate type compressor having a significantly reduced weight.

It is a second object of the present invention to provide a method of producing a blank used for manufacturing the piston of the invention.

The first object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A piston for a swash plate type compressor including a head portion which includes a cylindrical body portion whose open end is closed by a closure member, and an engaging portion which is formed integrally with the head portion on the side remote from the open end and which engages a swash plate of the compressor, wherein: the body portion includes a hollow cylindrical section whose inner circumferential surface is provided with a plurality of axially extending reinforcing projections, each of which protrudes from the inner circumferential surface in a radially inward direction of the hollow cylindrical section and which extends in a direction parallel to a centerline of the hollow cylindrical section over a substantially entire axial length thereof, the closure member being fixed to the body portion such that the closure member is held in abutting contact with an end face of each of the reinforcing projections on the side of the open end of the body portion.

The piston used in the compressor receives a pressure of a compressed gas at its end face which partially defines a pressurizing chamber in the compressor. In the piston constructed according to the present invention, the end face of the piston is provided by one of opposite major surfaces of the closure member (outer end face), on which a considerably high pressure of the gas acts in a direction in which the closure member is pushed into the hollow cylindrical section during manufacture, of the piston. In view of this, it is preferable that the closure member be fixed to the hollow cylindrical section such that the closure member is received and supported by the hollow cylindrical section at the other major surface (inner end face) opposite to the above-indicated outer end face.

If the wall thickness of the hollow cylindrical section is reduced to a value in a range of 1~2 mm for reducing the weight of the piston, the closure member cannot be received and supported by the hollow cylindrical section with high stability. For fixing the closure member to the hollow cylindrical section with their axes being aligned with each other, at least an axial portion of the closure member needs to be fitted in the hollow cylindrical section. For the following reasons, the reduction of the wall thickness of the hollow cylindrical section, however, makes it difficult that the closure member is fitted in the hollow cylindrical section with its inner end face being securely received and held in abutting contact with the hollow cylindrical section. When the hollow cylindrical section includes a large-diameter axial end portion formed on the side of its open end, which large-diameter axial end portion has an inside diameter larger than that of the other axial portion of the hollow cylindrical section, the closure member is fixed to the hollow cylindrical section such that the closure member is fitted in the large-diameter end portion such that a shoulder formed between the large-diameter end portion and the adjacent axial portion is held in abutting contact with the closure member. According to this arrangement, the closure member is held in position by the shoulder of the hollow cylindrical section while the axes of the hollow cylindrical section and the closure member are aligned with each other. When the wall thickness of the hollow cylindrical section is relatively small, the maximum inside diameter of the axial end portion is limited, so that the radial dimension of the shoulder is inevitably small. Where the large-diameter axial end portion has a low degree of concentricity with the hollow cylindrical section, the radial dimension of the shoulder is considerably small at a local circumferential portion thereof. In this case, the closure member fitted in the hollow cylindrical section cannot be sufficiently supported by the shoulder at the local circumferential portion. Accordingly, the closure member may undesirably be pushed into inner axial portion of the hollow cylindrical section by the pressure of the compressed gas acting thereon.

In the piston constructed according to the present invention wherein the hollow cylindrical section is provided with a plurality of axially extending reinforcing projections formed on its inner circumferential surface, the weight of the piston can be sufficiently reduced by reducing the wall thickness of the hollow cylindrical section at its circumferential parts in which the reinforcing projections are not formed, while permitting the closure member to be fixedly supported by the reinforcing projections. Accordingly, the present arrangement is effective to not only reduce the weight of the piston by reducing the wall thickness of the hollow cylindrical section, but also prevent the closure member from being pushed into the hollow cylindrical section upon exposure to the pressure of the compressed gas.

By suitably determining the cross sectional shape, location, and number of the reinforcing projections, the rigidity and mechanical strength of the hollow cylindrical section can be significantly increased, as compared with those of the hollow cylindrical section which has a constant wall thickness. This is based on a fact that the rigidity and mechanical strength of a relatively thin-walled structure can be increased when the structure is provided with reinforcing ribs. In this respect, the present arrangement is effective to improve the mechanical strength of the head portion of the piston while reducing its weight.

The head portion of the piston whose hollow cylindrical section is provided with the axially extending reinforcing projections as described above can be easily produced by die-casting. When the head portion of the piston whose hollow cylindrical section having a constant small wall thickness is produced by die-casting, the cast thin-walled structure has a relatively large circumferential surface area. It is, however, difficult to die-cast such a thin-walled structure since a molten metal does not easily flow through a mold cavity which has a relatively small radial dimension corresponding to the small wall thickness of the hollow cylindrical section and which has a relatively large diameter, whereby the mold cavity may not be uniformly and entirely filled with the molten metal. Accordingly, there is a limit to reduce the weight of the head portion of the piston by reducing the wall thickness of the hollow cylindrical section, due to the above-mentioned difficulty in the process of die-casting. In contrast, when the head portion of the piston whose hollow cylindrical section has the reinforcing projections is formed by die-casting, the molten metal comparatively easily flow through circumferential portions of the mold cavity, which portions have a relatively large radial dimension corresponding to the radial dimension of the reinforcing projections, so that the mold cavity can be uniformly and entirely filled with the molten metal, resulting in easy die-casting of the head portion of the piston. Accordingly, the lightweight piston can be produced efficiently by providing the reinforcing projections (thick-walled circumferential portions) on the inner circumferential surface of the hollow cylindrical section, rather than by reducing the wall thickness of the hollow cylindrical section to a constant small value.

(2) A piston according to the above mode (1), wherein the plurality of reinforcing projections are equally spaced apart from each other in the circumferential direction of the hollow cylindrical section (3) A piston according to the above mode (1) or (2), wherein each of the reinforcing projections protrudes from the inner circumferential surface in the radially inward direction of the hollow cylindrical portion by an amount which is not greater than 300% of a wall thickness of the hollow cylindrical section, and each of the reinforcing projections has a circumferential dimension as measured in the circumferential direction of the hollow cylindrical section, which is larger than the amount of protrusion from the inner circumferential surface, each of the reinforcing projections providing a thick-walled circumferential portion having a wall thickness larger than a nominal wall thickness of the hollow cylindrical section.

(4) A piston according to the above form (1) or (2), wherein each of the reinforcing projections is in the form of a rib which protrudes from the inner circumferential surface in the radially inward direction of the hollow cylindrical section by an amount which is larger than a circumferential dimension of the rib as measured in the circumferential direction of the hollow cylindrical section.

The hollow cylindrical section may have both of the projections according to the mode (3) and the ribs according to the above mode (4).

(5) A piston according to any one of the modes (1)–(4), wherein the closure member has a plurality of fitting protrusions formed on its inner end face, for engagement with the body portion so as to prevent relative rotation of the closure member and the body portion.

In the piston according to the above mode (5) of the present invention, the relative rotation of the closure member and the body portion is prevented by the engagement of the fitting protrusions of the closure member with the body portion, facilitating the machining operation which is effected during manufacture of the piston from a blank. For instance, a closing member which gives the closure member may have a holding portion formed on its outer end face remote from the fitting protrusions, so that the blank is held by a suitable chuck at the holding portion of the closing member. When the blank held by the chuck is rotated to perform the machining operation thereon, the closing member and the body portion are effectively prevented from being rotated relative to each other by the engagement of the fitting protrusions of the closing member with the body portion. The holding portion may be cut away from the closing member after the holding portion has achieved its function.

(6) A piston for a swash plate type compressor, including a hollow cylindrical head portion and an engaging portion which is formed integrally with the head portion and which engages a swash plate of the compressor, wherein the piston includes a plurality of axially extending reinforcing projections which are formed on an inner circumferential surface of the hollow cylindrical head portion, so as to extend in a direction parallel to a centerline of the hollow cylindrical head portion over a substantially entire axial length thereof.

The piston according to the above mode (6) is substantially the same as the piston according to the above mode (1), except that the piston according to the mode (6) does not include the feature that the end faces of the reinforcing projections are held in abutting contact with the inner end face of the closure member. This mode (6) aims to improve the rigidity and mechanical strength of the hollow cylindrical section itself. It is noted that the piston according to this mode (6) may employ the technical feature according to any one of the above modes (1) through (5).

The second object indicated above may be achieved according to the following mode (7) of the invention.

(7) A method of producing a blank used for manufacturing a piston for a swash plate type compressor, as defined in any one of the modes (1)–(6), comprising the steps of: preparing a casting mold consisting of two mold halves which define a parting plane at which the two mold halves are spaced apart from each other and butted together and which have respective molding surfaces; inserting, into the casting mold, a pair of slide cores which are slidably movable in a direction perpendicular to the parting plane, each of the slide cores having an outer circumferential surface whose configuration follows that of an inner circumferential surface of the hollow cylindrical section of the piston, the outer circumferential surface of each of the slide cores cooperating with the molding surfaces of the mold halves to define a mold cavity therebetween; injecting a molten metal into the mold cavity to form the blank for the piston; retracting the slide cores out of the casting mold; and moving the mold halves apart from each other at the parting plane to remove the blank formed in the mold cavity.

This mode (7) of the present invention permits easy production of the blank for manufacturing the piston defined in any one of the above modes (1) through (6).

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Figure 1:
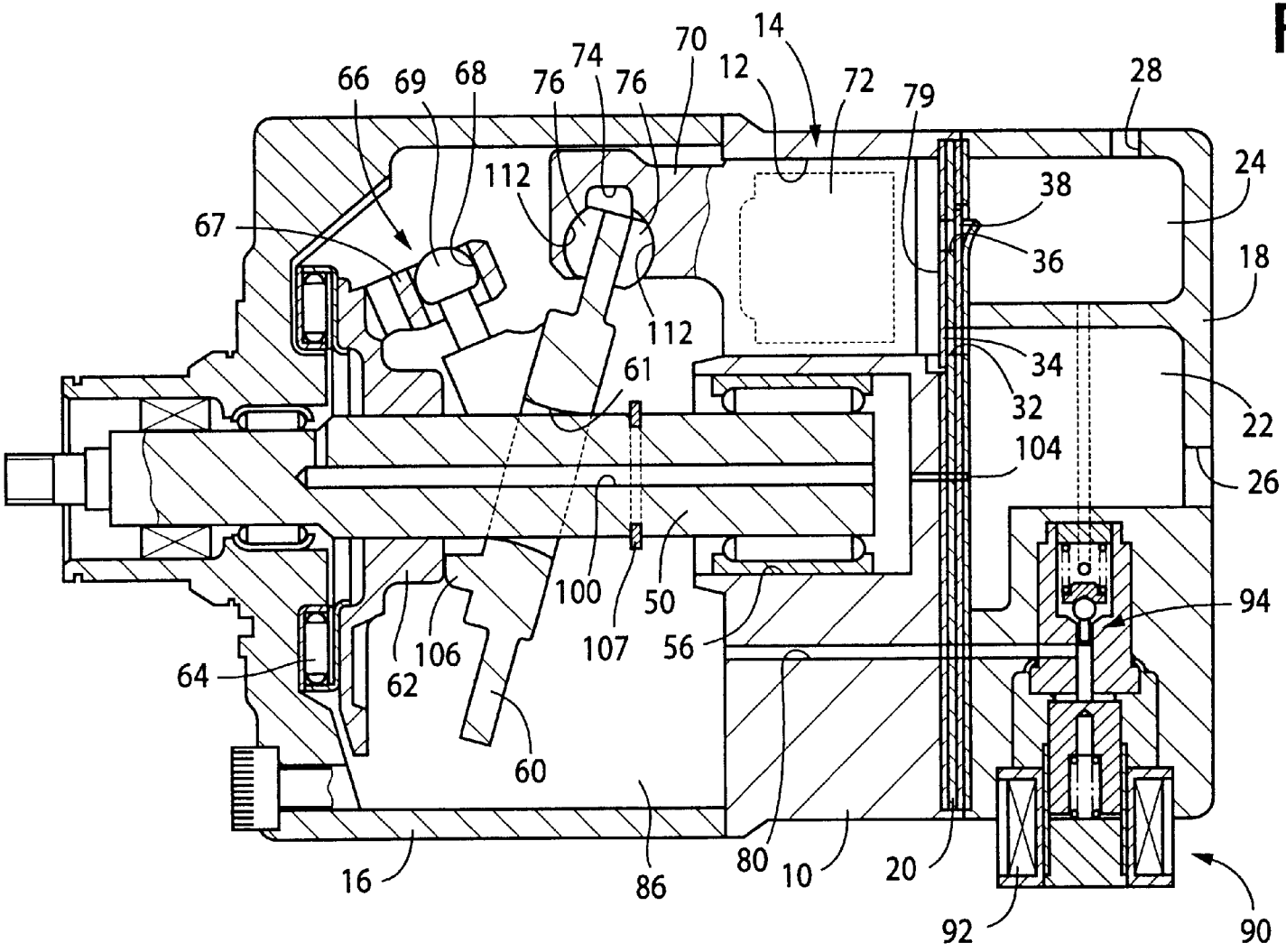
FIG. 1 is a front elevational view in cross section of a swash plate type compressor equipped with a piston constructed according to one embodiment of the present invention.

Referring first to FIG. 1, there is shown a compressor of swash plate type incorporating a plurality of single-headed pistons (hereinafter referred to simply as "pistons") each constructed according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. The piston generally indicated at 14 is reciprocably received in each of the cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation of the drive shaft 50 is aligned with the centerline of the cylinder block 10. The drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole, for supporting the drive shaft 50 at its rear end portion. The front end portion of the drive shaft 50 extends through a central portion of the front housing 16, such that the front end of the drive shaft 50 is located outside the front housing 16, so that the drive shaft 50 is connected to a drive power source (not shown). The rotary drive shaft 50 carries a swash plate 60 such that the swash plate 60 is axially movable and tiltable relative to the drive shaft 50. The swash plate 60 is mounted on the drive shaft 50 such that the drive shaft 50 passes through a central mounting hole 61 formed in the central portion of the swash plate 60. The diameter of the central mounting hole 61 of the swash plate 60 gradually increases in the axially opposite directions from its axially intermediate portion towards the axially opposite ends. To the drive shaft 50, there is fixed a rotary member 62 which is held in engagement with the front housing 16 through a thrust bearing 64. The swash plate 60 is rotated with the drive shaft 50 by a hinge mechanism 66 during rotation of the drive shaft 50. The hinge mechanism 66 guides the swash plate 60 for its axial and tilting motions. The hinge mechanism 66 includes a pair of support arms 67 fixed to the rotary member 62, guide pins 69 which are formed on the swash plate 60 and which slidably engage guide holes 68 formed in the support arms 67, the central mounting hole 61 of the swash plate 60, and the outer circumferential surface of the drive shaft 50.

The piston 14 indicated above includes a neck portion 70 engaging the swash plate 60, and a head portion 72 formed integrally with the neck portion 70 and fitted in the corresponding cylinder bore 12. The neck portion 70 has a groove 74 formed therein, and the swash plate 60 is held in engagement with the groove 74 through a pair of hemi-spherical shoes 76. The piston is reciprocated by rotation of the swash plate 60. The hemi-spherical shoes 76 are held in the groove 74 such that the shoes 76 slidably engage the neck portion 70 at their hemi-spherical surfaces and such that the shoes 76 slidably engage the radially outer portions of the opposite surfaces of the swash plate 60 at their flat surfaces. The configuration of the piston 14 will be described in detail.

A rotary motion of the swash plate 60 is converted into a reciprocating linear motion of the piston 14 through the shoes 76. A refrigerant gas in the suction chamber 22 is sucked into the pressurizing chamber 79 through the suction port 32 and the suction valve 34, when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is delivered into the discharge chamber 24 through the discharge port 36 and the discharge valve 38. A reaction force acts on the piston 14 in the axial direction as a result of compression of the refrigerant gas in the pressurizing chamber 79. This compression reaction force is received by the front housing 16 through the piston 14, swash plate 60, rotary member 62 and thrust bearing 64.

The cylinder block 10 has an intake passage 80 formed therethrough for communication between the discharge chamber 24 and a crank chamber 86 which is defined between the front housing 16 and the cylinder block 10. The intake passage 80 is connected to a solenoid-operated control valve 90 provided to control the pressure in the crank chamber 86. The solenoid-operated control valve 90 includes a solenoid coil 92, and a shut-off valve 94 which is selectively closed and opened by energization and de-energization of the solenoid coil 92. Namely, the shut-off valve 94 is placed in its closed state when the solenoid coil 92 is energized, and is placed in its open state when the coil 92 is de-energized.

The rotary drive shaft 50 has a bleeding passage 100 formed therethrough. The bleeding passage 100 is open at one of its opposite ends to the central bearing hole 56, and is open to the crank chamber 86 at the other end. The central bearing hole 56 communicates at its bottom with the suction chamber 22 through a communication port 104.

The present swash plate type compressor is a variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the crank chamber 86 which acts on the front side of the piston 14 and the pressure in the pressurizing chamber 79 is regulated to change the angle of inclination of the swash plate 60 with respect to a plane perpendicular to the axis of rotation of the drive shaft 50, for thereby changing the reciprocating stroke (suction and compression strokes) of the piston 14, whereby the discharge capacity of the compressor can be adjusted.

As described above, the pressure in the crank chamber 86 is controlled by controlling the solenoid-operated control valve 90 to selectively connect and disconnect the crank chamber 86 to and from the discharge chamber 24. Described more specifically, when the solenoid coil 92 of the solenoid-operated control valve 90 is energized, the intake passage 80 is closed, so that the pressurized refrigerant gas in the discharge chamber 24 is not delivered into the crank chamber 86. In this condition, the refrigerant gas in the crank chamber 86 flows into the suction chamber 22 through the bleeding passage 100 and the communication port 104, so that the pressure in the crank chamber 86 is lowered, to thereby increase the angle of inclination of the swash plate 60. The reciprocating stroke of the piston 14 which is reciprocated by rotation of the swash plate 60 increases with an increase of the angle of inclination of the swash plate 60, so as to increase an amount of change of the volume of the pressurizing chamber 79, whereby the discharge capacity of the compressor is increased. When the solenoid coil 92 is de-energized, the intake passage 80 is opened, permitting the pressurized refrigerant gas to be delivered from the discharge chamber 24 into the crank chamber 86, resulting in an increase in the pressure in the crank chamber 86, and the angle of inclination of the swash plate 60 is reduced, so that the discharge capacity of the compressor is accordingly reduced.

The maximum angle of inclination of the swash plate 60 is limited by abutting contact of a stop 106 formed on the swash plate 60, with the rotary member 62, while the minimum angle of inclination of the swash plate 60 is limited by abutting contact of the swash plate 60 with a stop 107 in the form of a ring fixedly fitted on the drive shaft 50. The solenoid coil 92 of the solenoid-operated control valve 90 is controlled by a control device not shown depending upon a load acting on the air conditioning system including the present compressor. The control device is principally constituted by a computer. In the present embodiment, the intake passage 80, the crank chamber 86, the solenoid-operated control valve 90, the bleeding passage 100, the communication port 104, and the control device for the control valve 90 cooperate to constitute a major portion of a crank chamber pressure control device for controlling the pressure in the crank chamber 86, or a swash plate angle adjusting device for controlling the angle of inclination of the swash plate 60.

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. The cylinder block 10 and the piston 14 may also be formed of a hyper-eutectic aluminum silicon alloy. Other materials may be used for the cylinder block 10, the piston 14, and the coating film.

There will next be described the configuration of the piston 14.

Figure 2:
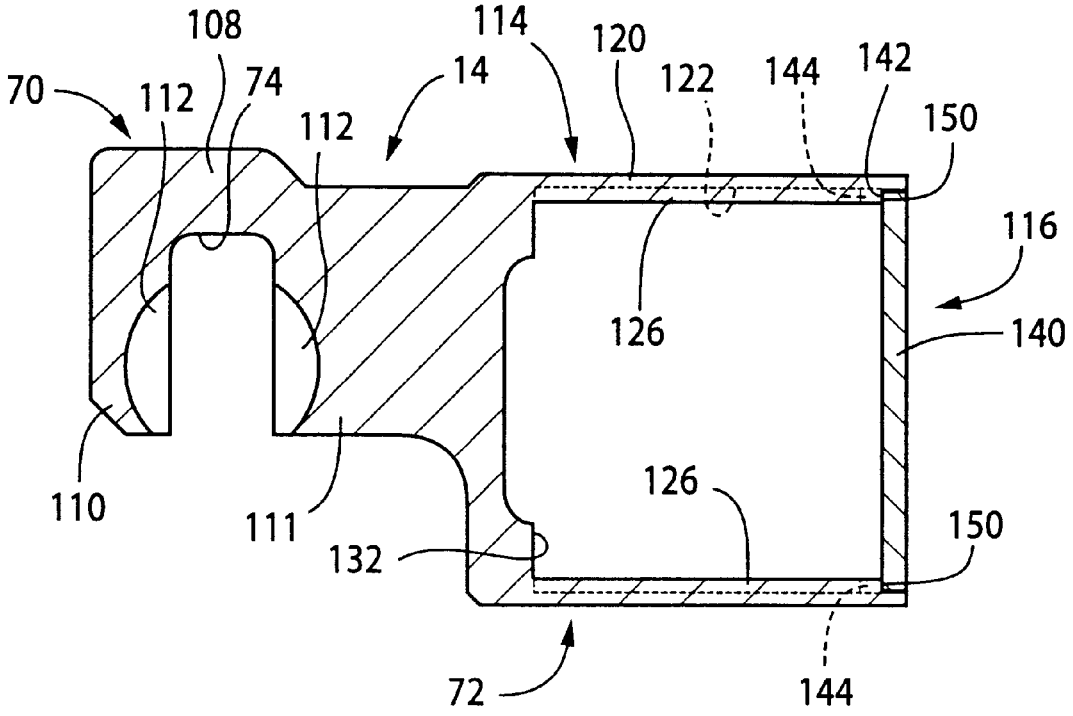
FIG. 2 is a front elevational view in cross section of the piston shown in FIG. 1.

The end portion of the neck portion 70 of the piston 14, which is remote from the head portion 72, has a U-shape in cross section, as shown in FIG. 2. Described in detail, the neck portion 70 has a base section 108 which defines the bottom of the U-shape and a pair of substantially parallel arm sections 110, 111 which extend from the base section 108 in a direction perpendicular to the axis of the piston 14. The two opposed lateral walls of the U-shape of the end portion of the neck portion 70 have respective recesses 112 which are opposed to each other. Each of these recesses 112 is defined by a part-spherical inner surface of the lateral wall. The pair of shoes 76 indicated above are held in contact with the opposite surfaces of the swash plate 60 at its radially outer portion and are received in the respective part-spherical recesses 112. Thus, the neck portion 70 slidably engages the swash plate 60 through the shoes 76. In the present embodiment, the neck portion 70 constitutes an engaging portion which engages the drive member in the form of the swash plate 60.

Figure 3:
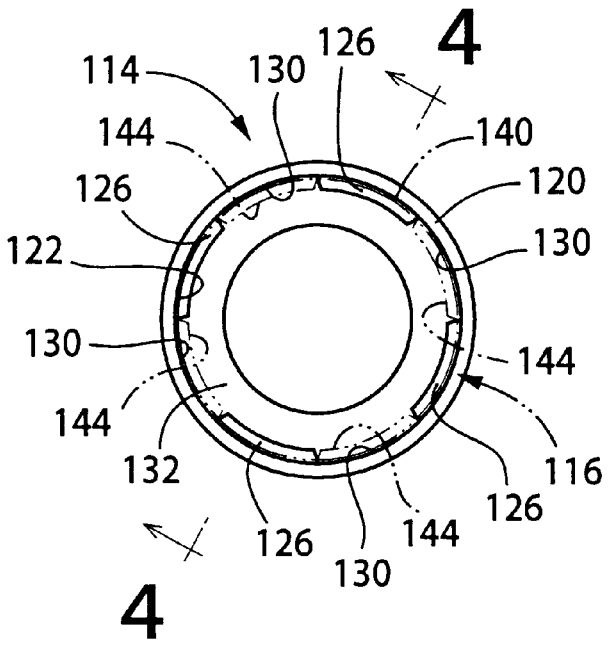
FIG. 3 is a right-hand side end elevational view of a body portion of a head portion of the piston of FIG. 2.
Figure 4:
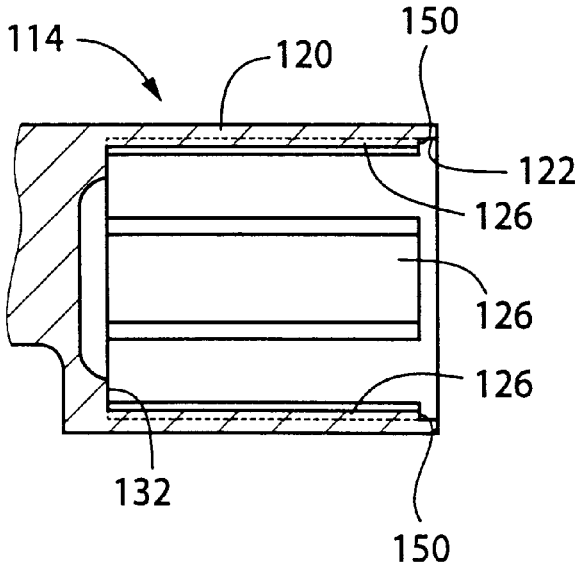
FIG. 4 is a cross sectional view taken along line 4—4 of FIG. 3.

The head portion 72 of the piston 14 is formed integrally with the neck portion 70 on the side of its arm section 111, and includes a cylindrical body portion 114 and a closure member 116 fixed to the body portion 114. The cylindrical body portion 114 is open at one of its opposite ends which is remote from the neck portion 70, and is closed at the other end. The closure member 116 closes the open end of the body portion 114. As shown in FIGS. 3 and 4, the body portion 114 includes a hollow cylindrical section 120 whose inner circumferential surface 122 is provided with a plurality of axially extending reinforcing projections 126. The plurality of reinforcing projections 126, four reinforcing projections in the present embodiment, are arranged equiangularly from each other in the circumferential direction of the hollow cylindrical section 120 and protrude from the inner circumferential surface 122 of the hollow cylindrical section 120 in the radially inward direction thereof. Each of the reinforcing projections 126 extends in the axial direction of the hollow cylindrical section 120 from an axial position near the open end of the body portion 114 to a bottom surface 132 of the hollow cylindrical section 120 on the side of the neck portion 70. Each reinforcing projection 126 has an arcuate cross sectional shape, as shown in FIG. 3, and has a circumferential dimension which is larger than a radial dimension thereof. Each reinforcing projection 126 protrudes from the inner circumferential surface 122 in the radially inward direction of the hollow cylindrical section 120 by an amount which is not less than 100% of the wall thickness of the hollow cylindrical section 120. More specifically, the wall thickness of the hollow cylindrical section 120 is about 0.8 mm while the radial dimension of the axial reinforcing projection 126 (the amount of protrusion of the projection 126 from the inner circumferential surface 122) is about 0.9 mm. For reducing the weight of the piston 14, the amount of protrusion of the reinforcing projection 126 is preferably within a range of 0.3~2.0 mm or 0.3~1.0 mm. In FIGS. 3 and 4, the thickness of the hollow cylindrical section 120 and the radial dimension of the reinforcing projections 126 are exaggerated for easier understanding.

By providing the axially extending reinforcing projections 126 on the inner circumferential surface 122 of the hollow cylindrical section 120 described above, the hollow cylindrical section 120 has thin-walled portions having the nominal wall thickness, i.e., 0.8 mm, in which the reinforcing projections 126 are not formed, and thick-walled portions whose thickness is a sum of the nominal wall thickness (0.8 mm) of the hollow cylindrical section 120 and the amount of protrusion (0.9 mm) of the reinforcing projections 126 from the inner circumferential surface 122, i.e., 1.7 mm.

According to this arrangement, the cylindrical body portion 114 of the piston 14 has a sufficient mechanical strength owing to the reinforcing projections 126 (thick-walled portions), while permitting the piston 14 to have a reduced weight owing to the thin-walled portion of the hollow cylindrical section 120. Further, the closure member 116 is securely fixed in the open end portion of the hollow cylindrical section 120, with its inner end face 142 held in abutting contact with the reinforcing projections 126, as described below in greater detail.

As shown in FIG. 3, the hollow cylindrical section 120 has a plurality of engaging grooves 130, each of which is defined by opposed lateral or side surfaces of the adjacent two reinforcing projections 126 and the inner circumferential surface 122. The engaging grooves 130, which correspond to the above-indicated thin-walled portions, are arranged equiangularly from each other in the circumferential direction of the hollow cylindrical section 120, such that each groove 130 is interposed between the adjacent reinforcing projections 126. According to this arrangement, the hollow cylindrical section 120 has a constant wall thickness at its open end, and the alternately arranged thick-walled portions and thin-walled portions which extend from the axial position near the open end to the bottom surface 132 of the hollow cylindrical section 120 and which cooperate to take the form of a spline in transverse cross section.

Figure 5:
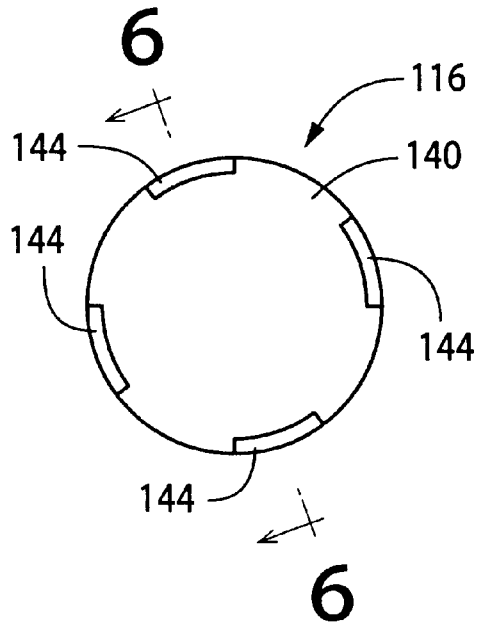
FIG. 5 is a side elevational view of the closure member of the piston of FIG. 2.
Figure 6:
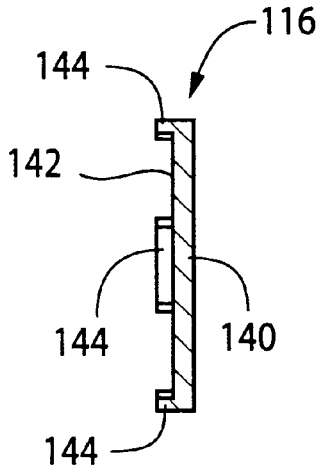
FIG. 6 is a cross sectional view taken along line 6—6 of FIG. 5.

The closure member 116 is a generally disc-shaped member which consists of a circular plate portion 140, and a plurality of fitting protrusions 144 (four fitting protrusions in this embodiment) which protrude from the outer peripheral portions of one of the opposite end faces of the plate portion 140, i.e., the inner end face 142, of the plate portion 140, and which are arranged equiangularly from each other in the circumferential direction of the plate portion 140. Each fitting protrusion 144 has a circumferential dimension which is larger than its radial dimension, and has an arcuate cross sectional shape, as shown in FIG. 5. In the present embodiment, the outer part-circumferential surface of each fitting protrusion 144 is continuously contiguous to or flush with the outer circumferential surface of the circular plate portion 140. As indicated in the two-dot chain line in FIG. 3, the closure member 116 is shaped to be held in engagement with the inner circumferential surface 122 of the hollow cylindrical section 120 of the body portion 114. Namely, each fitting protrusion 144 of the closure member 116 is dimensioned and located in the circumferential direction of the circular plate portion 140 so as to be held in engagement with the corresponding engaging groove 130 of the hollow cylindrical section 120.

The closure member 116 is fitted in the inner circumferential surface 122 of the hollow cylindrical section 120 such that the inner end face 142 of the closure member 116 is held in abutting contact with end faces 150 of the respective reinforcing projections 126 on the side of the open end of the body portion 114. Described in detail, the outer circumferential surface of the circular plate portion 140 of the closure member 116 engages the axial end portion of the inner circumferential surface 122, while each fitting protrusion 144 engages the corresponding engaging groove 130 of the hollow cylindrical section 120 of the body portion 114. In this state, the body portion 114 and the closure member 116 are welded together. The compression reaction force which acts on the end face of the piston 14 (which partially defines the pressurizing chamber 79), as a result of compression of the refrigerant gas in the pressurizing chamber 79 during the compression stroke of the piston 14, is received by the end faces 150 of the reinforcing projections 126 and the inner end face 142 of the closure member 116 which are held in abutting contact with each other, as well as the contacting circumferential surfaces of the body portion 114 and the closure member 116, which surfaces are bonded together by welding. When the closure member 116 engages the inner circumferential surface 122 of the hollow cylindrical section 120 of the body portion 114 as described above, the relative rotation of the closure member 116 and the body portion 114 is prevented by the engagement of the lateral or side surfaces of the adjacent axial reinforcing projection 126 and the fitting protrusion 144.

Figure 7:
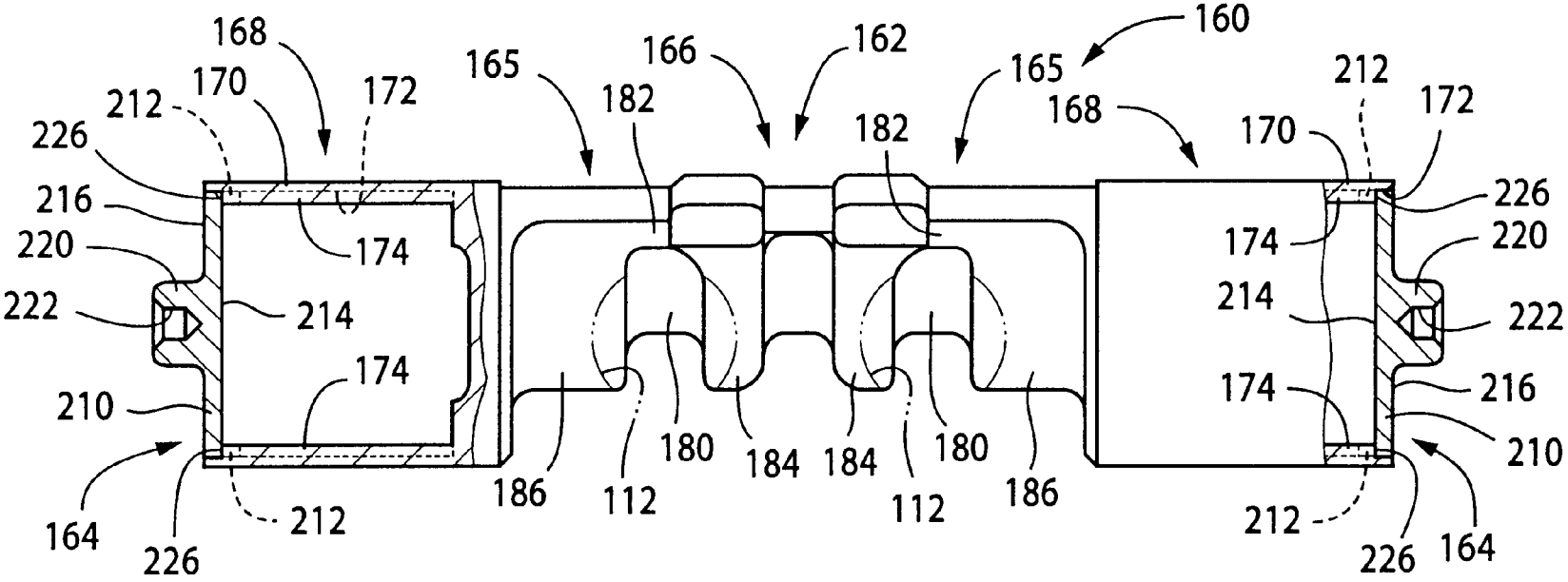
FIG. 7 is a front elevational view partly in cross section showing a blank used for manufacturing the piston of FIG. 2, after closing members are fixed to a body member of the blank.

Two pieces of the piston 14 constructed as described above are produced from a single blank 160 shown in FIG. 7. The blank 160 used for producing the two pistons 14 has a body member 162 and two closing members 164. The body member 162 consists of a twin neck section 166 and two cylindrical hollow head sections 168 formed integrally with the twin neck section 166 such that the two hollow head sections 168 extend from the opposite ends of the twin neck section 166 in the opposite directions. The twin-neck section 166 consists of mutually integrally formed two portions which correspond to the neck portions 165 of the two single-headed pistons 14. Each of the two hollow head sections 168 is closed at one of its opposite ends which is on the side of the twin neck section 166, and has a hollow cylindrical section 170 which is open at the other end and which corresponds to the hollow cylindrical body portion 114 of the head portion 72 of the piston 14.

Figure 9:
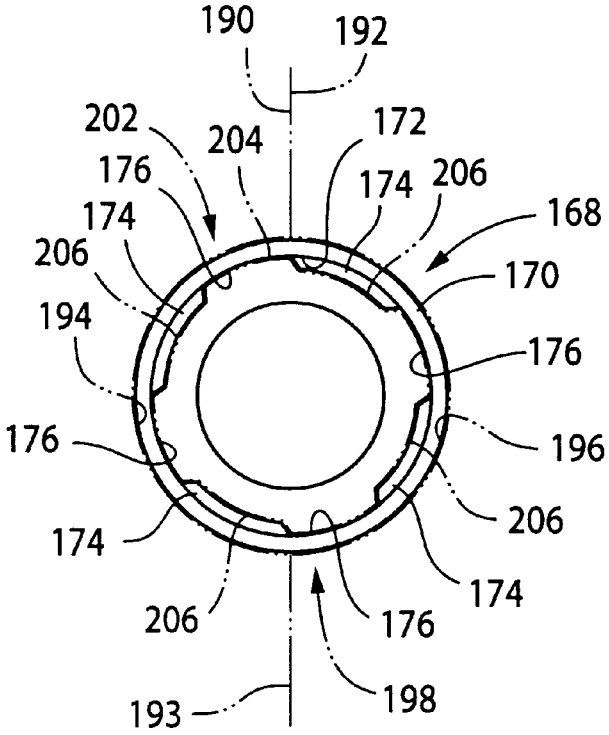
FIG. 9 is a right-hand side end elevational view of the body member of FIG. 8.

On the inner circumferential surface 172 of the hollow cylindrical section 170 of each head section 168, four axially extending reinforcing projections 174 are formed so as to protrude from the inner circumferential surface 172 in a radially inward direction of the hollow cylindrical section 170. The inner circumferential surface 172 cooperates with the lateral surfaces of the two adjacent reinforcing projections 174 to define an engaging groove 176. Namely, four engaging grooves 176 are formed in the inner circumferential surface 172 as shown in FIG. 9. The reinforcing projections 174 and the engaging grooves 176 respectively function as the reinforcing projections 126 and the engaging grooves 130 of the piston 14. The hollow cylindrical section 170 and each reinforcing projection 174 of the blank 160 have the same dimensional relationship as the hollow cylindrical section 120 and each reinforcing projection 126, and a detailed description of which is dispensed with. The body member 162 is formed by die-casting of a metallic material in the form of an aluminum alloy. This formation of the body member 162 by die-casting is a step of preparing the body member 162. Each of the two neck portions 165 of the twin neck portion 166 includes a base section 182 functioning as the base portion 182 of the piston 14 and a pair of opposed parallel arm sections 184, 186 functioning as the arm sections 110, 111 of the piston 14. Reference numeral 180 denotes two bridge portions, each of which connects the inner surfaces of the arm sections 184, 186, in order to reinforce the neck portion 165 for thereby increasing the rigidity of the body member 162. Each bridge portion 180 functions as a reinforcing portion by which the body member 162 is protected from being deformed due to heat.

Figure 8:
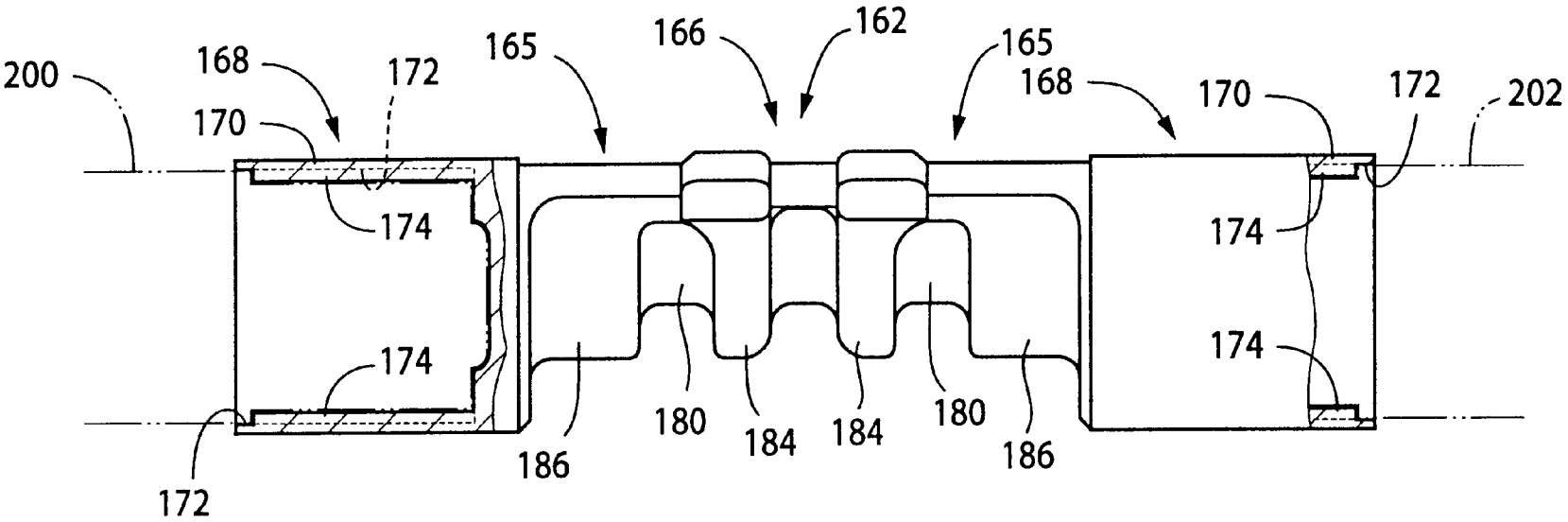
FIG. 8 is a front elevational view partly in cross section showing the body member of the blank of FIG. 7.

There will be described a process of manufacturing the body member 162 by die-casting by referring to FIGS. 8 and 9.

A casting mold used for producing the body member 162 consists of two mold halves, one of which is stationary and the other of which is movable relative to the stationary mold half. The contact surfaces 190, 192 of the two mold halves define a parting plane 193, at which the two mold halves are butted together and are spaced apart from each other by a suitable moving device not shown. As indicated by a two-dot chain line in FIG. 9, the parting plane 193 includes the centerline of the blank 160 passing the centers of the generally cylindrical head sections 168 and is parallel to the direction of extension of the arm sections 184, 186 from the base sections 182 of the neck portions 165. The two mold halves have respective molding surfaces 194, 196 which cooperate with outer circumferential surfaces 204 of slide cores 200, 202, to define a mold cavity 198 whose profile follows that of the body member 162. The slide cores 200, 202 are disposed in the casting mold consisting of the two mold halves, such that the slide cores 200, 202 are advanced into and retracted out of the casting mold by a suitable drive device not shown. The slide cores 200, 202 indicated in the two-dot chain line in FIGS. 8 and 9 are slidably movable relative to each other in a direction parallel to the centerline of the cylindrical head sections 168 and in a direction perpendicular to the parting direction of the mold halves described above. Each of the slide cores 200, 202 includes a front end portion to be inserted into the casting mold and a cylindrical portion remote from the front end portion. In the outer circumferential surface 204 of the front end portion of each slide core 200, 202, there are formed axially extending four recesses 206 which extend in the axial direction of the slide core and which are dimensioned and disposed so as to give the four reinforcing projections 174 described above. The cylindrical portion of each slide core 200, 202 has an outside diameter which corresponds to the inside diameter of the hollow cylindrical section 170 at an axial portion thereof in which the reinforcing projections 174 are not formed. Each slide core 200, 202 is movable between an advanced position in which the outer circumferential surface 204 of each slide core 200, 202 cooperates with the molding surfaces 194, 196 of the two mold halves to define the molding cavity 198, and a retracted position in which the front end portion of each slide core 200, 202 is located outside the casting mold.

By using the casting mold and the slide cores 200, 202 constructed as described above, the body member 162 is die-cast in the following manner. Initially, the movable mold half is assembled with the stationary mold half at the parting plane 193 so that the two mold halves are prevented from moving relative to each other. After each slide core 200, 202 is placed in the advanced position described above, a molten metal, i.e., a molten aluminum alloy is injected, via a channel not shown, into the mold cavity 198 which is defined between the molding surfaces 194, 196 of the two mold halves and the outer circumferential surfaces 204 of the slide cores 200, 202. The injected molten metal flows mainly through portions of the mold cavity 198, which portions correspond to the thick-walled circumferential portions of the hollow cylindrical section 170 in which the reinforcing projections 174 are formed and which have a radial dimension larger than the other circumferential portions, namely, the thin-walled circumferential portions of the hollow cylindrical section 170 in which the engaging grooves 176 are formed. Thus, the molten metal more easily flows to uniformly fill the mold cavity 198 in the present mold, than in a mold wherein the mold cavity has a constant radial dimension for forming a hollow cylindrical section without the reinforcing projections 174. Accordingly, the present arrangement results in easy manufacture of the body member 162.

Subsequently, the movable mold half is separated from the stationary mold half a predetermined time after the molten metal was injected into the mold cavity 198, and the slide cores 200, 202 are retracted out of the formed head sections 168. Then, the formed body member 162 is removed from the stationary mold half.

The two closing members 164 are identical in construction with each other as shown in FIG. 7. Like the closure member 116, each of these closing members 164 includes a circular plate portion 210 and four fitting protrusions 212 which provide as the fitting protrusions 212 of the piston 14. The circular plate portion 210 and the fitting protrusions 212 of the closing member 164 have the same dimensional relationship as the circular plate portion 140 and the fitting protrusions 144 of the closure member 116, and a detailed explanation of which is dispensed with. The circular plate portion 210 of each closing member 164 has a holding portion 220 formed at a central portion of an outer end face 216 which is opposite to the inner end face 214 on which the fitting protrusions 212 are formed. The holding portion 220 has a circular shape in cross section, and has a center hole 222. In the present embodiment, the closing member 164 is formed by die-casting of a metallic material in the form of an aluminum alloy. This formation of the closing members 164 by die-casting is a step of preparing the closing members 164.

Figure 10:
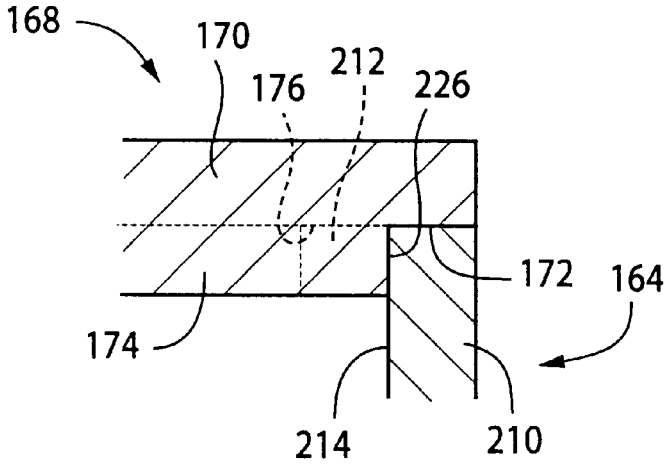
FIG. 10 is a fragmentary enlarged front elevational view in cross section showing engagement of the closing member with the body member.

To fix the closing members 164 to the body member 162, each closing member 164 is inserted into the open end of the head section 168 while the four fitting protrusions 212 of the closing member 164 are held in alignment with the respective engaging grooves 176 of the head section 168. As shown in the enlarged view of FIG. 10, the outer circumferential surface of the circular plate portion 210 of the closing member 164 engages the inner circumferential surface 172 of the head section 168 while the fitting protrusions 212 of the closing member 164 engage the respective engaging grooves 176 of the head section 168, whereby the closing member 164 is fixed to the body member 162 with their axes being aligned with each other. The closing member 164 is inserted into the open end of the head section 168 until the inner end face 214 of the circular plate portion 210 is brought into abutting contact with the end faces 226 of the respective reinforcing projections 174 formed on the inner circumferential surface 172 of the hollow cylindrical section 170 of the body section 168. With each closing member 164 fitted in the body member 162 as described above, the inner circumferential surface 172 of the head section 168 and the outer circumferential surface of the circular plate portion 210 of the closing member 164 are held close to or in abutting contact with each other, so that these inner and outer circumferential surfaces are bonded to each other by means of an electron beam welding. In the welding operation, an assembly of the body member 162 and the two closing members 164 fitted in the body member 162 is held and sandwiched by and between a pair of jigs not shown such that each closing member 164 is pressed onto the body member 162 by each jig with the holding portion 220 of the closing member 164 being fitted in a hole formed in the jig. In this state, a torque is applied to each closing member 164 through the jig by a suitable drive device, so that the assembly of the body member 162 and the closing members 164 is rotated. Then, the electron beam is incident upon the body member 162 and the closing members 164, so that these members are welded together at the contacting inner and outer circumferential surfaces described above. The closing members 164 are prevented from being removed away from the body member 162 by the engagement of the lateral surfaces of the reinforcing projections 174 of the head section 168 with the lateral surfaces of the fitting protrusions 212 of the closing members 164, and by the jigs which press the closing members 164 onto the body member 162, permitting an efficient welding of these members.

In the present embodiment, since the body member 162 and each closing member 164 are both formed by die-casting and have a high dimensional accuracy, the closing members 164 are fitted in the body member 162 without prior mechanical working operations such as machining and grinding operations, resulting in a reduced cost of manufacture of the blank 160 for the single-headed pistons 14.

After the two closing members 164 are fixedly fitted in the respective open end portions of the body member 162 as described above, a machining operation is performed on the outer circumferential surfaces of the hollow head sections 168 of the body member 162 and the exposed outer circumferential surfaces (FIG. 11) of the closing members (300). This machining operation is effected on a lathe or turning machine such that the blank 160 is held by chucks at the holding portions 220 of the closing members 164, with the blank 160 being centered with two centers engaging the center holes 222, and such that the blank 160 is rotated by a suitable drive device. Since the closing members 164 are fixed to the body member 162 by welding, and the lateral surfaces of the reinforcing projections 174 of the head section 168 engage the lateral surfaces of the fitting protrusions 212 of each closing member 164, the closing members 164 and the body member 162 are prevented from rotating relative to each other, so that the blank 160 can be turned as a whole for efficient machining on its outer circumferential surface.

Then, the outer circumferential surfaces of the hollow head sections 168 of the body member 162 and the closing members are coated with a suitable material, such as a film of polytetrafluoroethylene. The blank 160 is then subjected to a machining operation to cut off the holding portions 220 from the closing members 164, and a centerless grinding operation on the coated outer circumferential surfaces of the hollow head sections 168 and the closing members, so that the two portions which provide the head portions 72 of the two pistons 14 are formed. In the next step, a cutting operation is performed near the two bridge portions 180 of the twin-neck section 166, to form the recesses 112 in which the shoes 76 of the pistons 14 are received. Thus, the two portions which provide the neck portions 70 of the two pistons 14 are formed at the twin neck section 166. Finally, the twin neck section 166 is subjected at its axially central portion to a cutting operation to cut the blank 160 into two pieces which provide the respective two single-headed pistons 14.

The present embodiment described above is effective to reduce the weight of the piston 14 by reducing the wall thickness of the hollow cylindrical section 120 of the body portion 114 of the piston 14 while the closure member 116 is received and supported with high stability by the axially extending reinforcing projections formed on the inner circumferential surface 122 of the hollow cylindrical section 120. According to this arrangement, the compression reaction force acting, during the compression stroke of the piston, on the end face of the piston 14 which partially defines the pressurizing chamber 79, can be received by the abutting contact of the end faces 150 of the respective reinforcing projections 126 with the inner end face 142 of the closure member 116, whereby the closure member 116 is prevented from being pushed into the cylindrical body section 120 of the body portion 114, resulting in an improved mechanical strength of the head portion 72 of the piston 14 on the side of its end face partially defining the pressurizing chamber 79. Further, since the reinforcing projections 126 are formed on the inner circumferential surface 122 of the hollow cylindrical section 120 of the body portion 114, so as to extend over substantially the entire axial length of the hollow cylindrical section 120, the hollow cylindrical section 120 exhibits a sufficiently high degree of rigidity and mechanical strength with respect to buckling.

Figure 11:
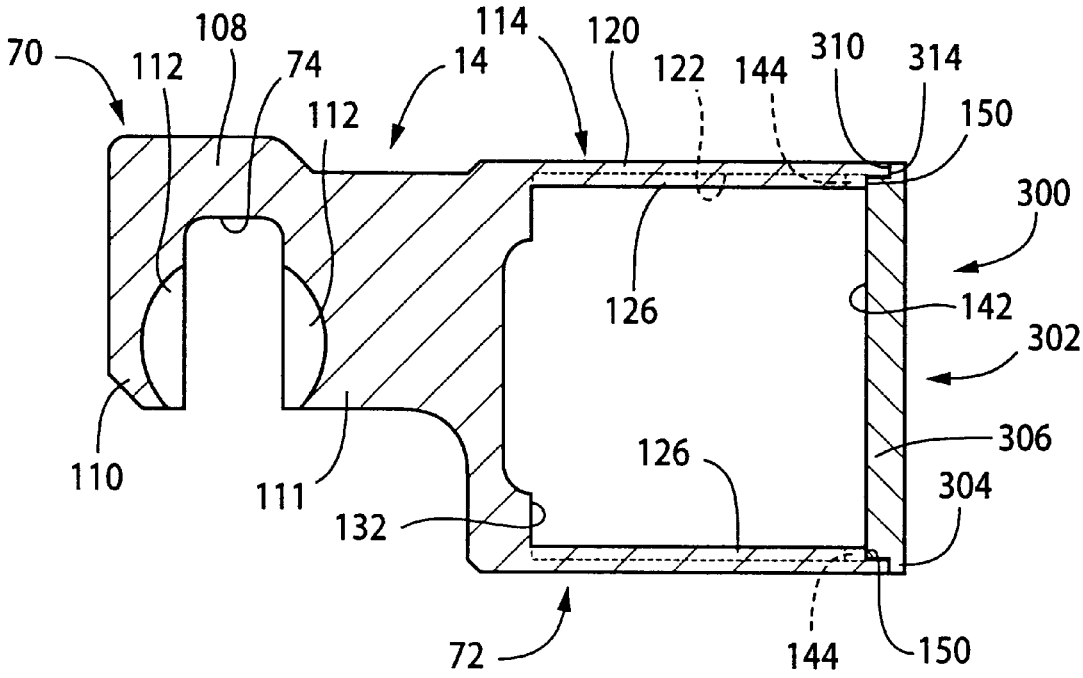
FIG. 11 is a front elevational view in cross section of a piston constructed according to another embodiment of the present invention.

The closure member may be otherwise constructed. For instance, the closure member 300 shown in FIG. 11 has a circular plate portion 302 which includes a large-diameter portion 304, a small-diameter portion 306, and a shoulder 310 formed therebetween. The large-diameter portion 304 has an outside diameter equal to that of the hollow cylindrical section 120 of the body portion 114. The small-diameter portion 306 is fitted at its outer circumferential surface in the inner circumferential surface 122 of the hollow cylindrical section 120. The closure member 300 is fitted in the inner circumferential surface 122 of the hollow cylindrical section 120 of the body portion 114 such that the shoulder 310 of the closure member 300 is held in abutting contact with the annular end face 314 of the hollow cylindrical section 120 on the side of its open end, and such that the inner end face 142 of the closure member 300 is held in abutting contact with the end faces 150 of the respective reinforcing projections 126 of the body portion 114. In this state, the closure member 300 is welded to the body portion 114. In this arrangement, the compression reaction force of the refrigerant gas acting, during the compression stroke of the piston 14, on the end face of the piston 14 partially defining the pressurizing chamber 79, is received by the abutting contact of the annular end face 314 of the hollow cylindrical section 120 with the shoulder 310 of the closure member, as well as the abutting contact of the end faces 150 of the respective reinforcing projections 126 with the inner end face 142 of the closure member 300, to thereby increase the mechanical strength of the head portion 72 of the piston 14. In FIG. 11, the same reference numbers as used in FIGS. 1–10 are used to identify the corresponding components, and a detailed description of which is dispensed with. The piston 14 of FIG. 11 is produced in a manner similar to that for producing the piston 14 of FIGS. 1–10, and a detailed description of which is dispensed with.

The reinforcing projections 126 shown in FIGS. 1–10 may be otherwise constructed by suitably changing the cross sectional shape, location, and numbers thereof, as shown in the following embodiments of FIGS. 12–14, wherein the same reference numerals as used in FIGS. 1–10 are used to identify the corresponding components, and a detailed description of which is dispensed with. The piston is produced by using the body portions 114 having different reinforcing projections shown in FIGS. 12–14, in a manner similar to that in FIGS. 1–10, and a detailed description of which is dispensed with.

Figure 12:
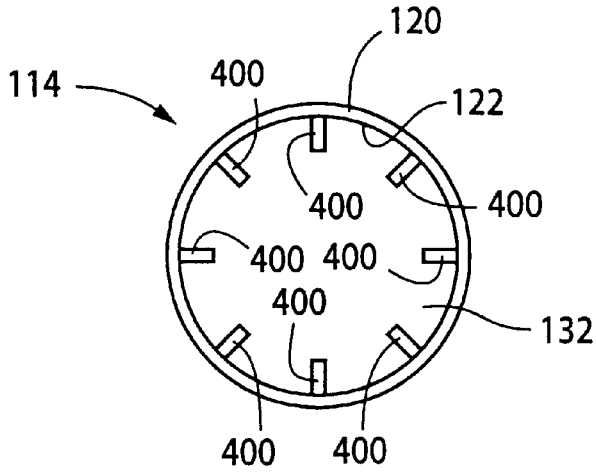
FIG. 12 is an end elevational view of a cylindrical body portion of a piston according to still another embodiment of the invention.

The body portion 114 shown in FIG. 12 has a plurality of axially extending reinforcing projections in the form of ribs 400, eight reinforcing ribs 400 in this embodiment, which are arranged equiangularly from each other in the circumferential direction of the body portion 114 and each of which protrudes from the inner circumferential surface 122 of the hollow cylindrical section 120 in its radially inward direction. Each reinforcing rib 400 is formed on the inner circumferential surface 122 such that the reinforcing rib 400 extends from an axial position of the hollow cylindrical section 120 near its open end to the bottom surface 132 over substantially the entire axial length of the hollow cylindrical section 120. Each reinforcing rib 400 is rectangular in cross section, and has a radial dimension (an amount of protrusion from the inner circumferential surface 120) larger than its circumferential dimension as measured in the circumferential direction of the hollow cylindrical section 120. In the present embodiment, the circumferential dimension of each rib 400 is equal to the wall thickness of the hollow cylindrical section 120 while the radial dimension (the amount of protrusion) is about two times the wall thickness of the hollow cylindrical section 120. The radial dimension of the rib 400 is preferably within a range between not less than 100% or 200% of the wall thickness of the hollow cylindrical section 200 and not greater than 400% or 300% of the wall thickness of the hollow cylindrical section 120. It is preferable that at least three reinforcing ribs 400 be formed on the inner circumferential surface 122 of the hollow cylindrical section 120.

Figure 13:
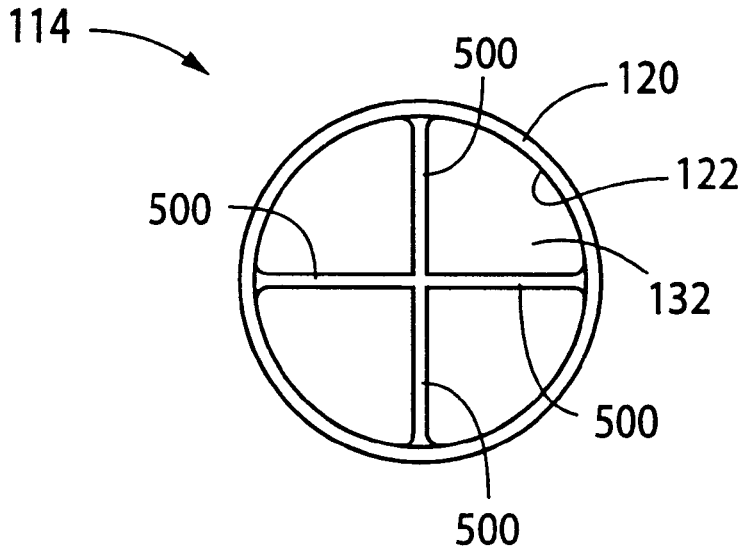
FIG. 13 is an end elevational view of a cylindrical body portion of a piston according to yet another embodiment of the invention.
Figure 14:
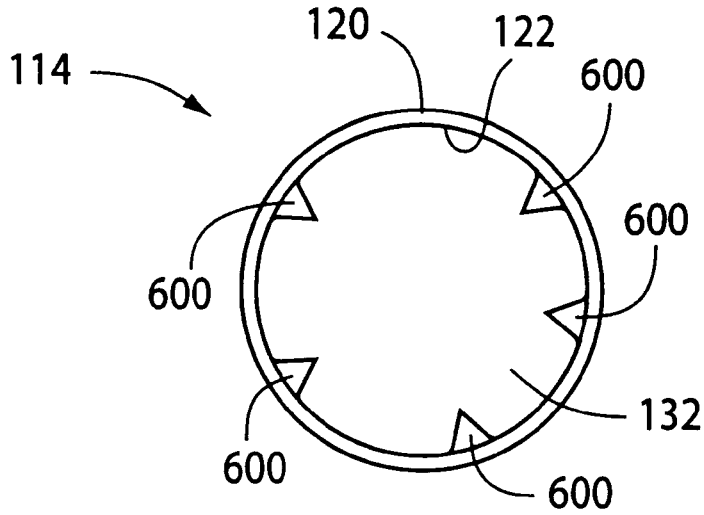
FIG. 14 is an end elevational view of a cylindrical body portion of a piston according to a further embodiment of the invention.

The body portion 114 shown in FIG. 13 has four axially extending reinforcing projections in the form of walls 500 which are arranged equiangularly from each other in the circumferential direction of the hollow cylindrical section 120 of the body portion 114. Each reinforcing wall 500 extends from an axial position of the hollow cylindrical section 120 near its open end to the bottom surface 132 over substantially the entire axial length of the hollow cylindrical section 120. Like the reinforcing rib 400 in FIG. 12, the reinforcing wall 500 has a radial dimension (an amount of protrusion from the inner circumferential surface 120) which is larger than its circumferential dimension as measured in the circumferential direction of the hollow cylindrical section 120. Each of the reinforcing walls 500 protrudes from the inner circumferential surface 122 of the hollow cylindrical section 120 in its radially inward direction, so that the four reinforcing walls 500 are connected together at the center of the hollow cylindrical section 120, as shown in FIG. 13.

The reinforcing projections need not be located equiangularly from each other in the circumferential direction of the hollow cylindrical section 120 of the body portion 114. For instance, a plurality of axially extending reinforcing projections 600, e.g., five reinforcing projections 600 in the embodiment shown in FIG. 14, are not equally spaced apart from each other in the circumferential direction of the hollow cylindrical section 120 of the body portion 114. The reinforcing projections 600 of FIG. 14 have a triangular cross sectional shape whose circumferential dimension decreases with an increase of the radial distance from the inner circumferential surface 122.

The reinforcing projections may consist of a combination of projections and/or ribs such as the projections 144, 600 and the ribs 400, 500.

The configuration of the closure member is not particularly limited. For instance, the closure member is a circular plate which engages the inner circumferential surface 122 of the hollow cylindrical section 120 such that one of its opposite end faces is held in abutting contact with the end faces of the respective reinforcing projections. Alternatively, the closure member may have fitting protrusions (144) protruding from one of its opposite end faces, as in the illustrated embodiments. The configuration of the fitting projections of the closure member is not particularly limited.

The parting plane which is defined by the two mold halves of the casting mold used for die-casting the blank for the two single-headed pistons may be otherwise established. For instance, the parting plane may be parallel to a plane which includes a centerline of the blank 160 passing the centers of the cylindrical body portions 168 and which is perpendicular to the direction of extension of the arm sections 184, 186 from the base sections 182. In this case, the parting plane passes a part of the neck portions 165 which has the largest dimension as measured in the direction perpendicular to the direction of extension the arm sections 184, 186.

The closing members may be welded to the body member of the blank for the piston by means of a laser beam. Alternatively, the closing members and the body member may be bonded together by any suitable means other than the beam welding. For instance, the closing members are fixed to the body member by bonding using an adhesive agent or an alloy having a lower melting point than those members, such as a soldering or brazing material. Further, the closing members may be fixed to the body member by caulking or by means of screws. Alternatively, the closing members may be fixed to the body member by utilizing frictional contact or plastic material flow between the two members. The above-described methods may be employed in combination.

The blank for the piston may be formed by forging. In this case, two closing members are formed integrally with a twin neck member, and each closing member closes the open end of the corresponding one of two hollow cylindrical members each of which gives the head portion of the piston.

The construction of the swash plate type compressor for which the piston 14 is incorporated is not limited to that of FIG. 1. For instance, the solenoid-operated control valve 90 is not essential, and the compressor may use a shut-off valve which is mechanically opened and closed depending upon a difference between the pressures in the crank chamber 86 and the suction chamber 22. In place of or in addition to the solenoid-operated control valve 90, a solenoid-operated control valve similar to the control valve 90 may be provided in the bleeding passage 100. Alternatively, a shut-off valve may be provided, which is mechanically opened or closed depending upon a difference between the pressures in the crank chamber 86 and the discharge chamber 24. Further, the swash plate type compressor may be of a fixed capacity type, wherein the angle of inclination of the swash plate is fixed. The swash plate type compressor may employ double-headed pistons.

While some presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A piston for a swash plate type compressor including a head portion which includes a cylindrical body portion whose open end is closed by a closure member, and an engaging portion which is formed integrally with said head portion on the side remote from said open end and which engages a swash plate of the compressor, wherein the improvement comprises:

said body portion including a hollow cylindrical section whose inner circumferential surface is provided with a plurality of axially extending reinforcing projections, each of which protrudes from said inner circumferential surface in a radially inward direction of said hollow cylindrical section and which extends in a direction parallel to a centerline of said hollow cylindrical section over a substantially entire axial length thereof, said closure member being fixed to said body portion such that said closure member is held in abutting contact with an end face of each of said reinforcing projections on the side of said open end of said body portion.

2. A piston according to claim 1, wherein said plurality of reinforcing projections are equally spaced apart from each other in the circumferential direction of said hollow cylindrical section.

3. A piston according to claim 2, wherein each of said reinforcing projections protrudes from said inner circumferential surface in said radially inward direction of said hollow cylindrical portion by an amount which is not greater than 300% of a wall thickness of said hollow cylindrical section, and said each of said reinforcing projections has a circumferential dimension as measured in the circumferential direction of said hollow cylindrical section, which is larger than said amount of protrusion from said inner circumferential surface, said each of said reinforcing projections providing a thick-walled circumferential portion having a wall thickness larger than a nominal wall thickness of said hollow cylindrical section.

4. A piston according to claim 1, wherein said each of said reinforcing projections is in the form of a rib which protrudes from said inner circumferential surface in said radially inward direction of said hollow cylindrical section by an amount which is larger than a circumferential dimension of said rib as measured in the circumferential direction of said hollow cylindrical section.

5. A piston according to claim 1, wherein said closure member has a plurality of fitting protrusions formed on its inner end face, for engagement with said body portion so as to prevent relative rotation of said closure member and said body portion.

6. A piston for a swash plate type compressor including a hollow cylindrical head portion and an engaging portion which is formed integrally with said head portion and which engages a swash plate of the compressor, wherein the improvement comprises:

a plurality of axially extending reinforcing projections being formed on an inner circumferential surface of said hollow cylindrical head portion, so as to extend in a direction parallel to a centerline of said hollow cylindrical head portion over a substantially entire axial length thereof.

* * * * *